US008001877B2

(12) United States Patent
Schmidt et al.

(10) Patent No.: US 8,001,877 B2
(45) Date of Patent: Aug. 23, 2011

(54) TOOL HOLDING SYSTEM

(75) Inventors: Christoph Schmidt, Stuttgart (DE); Werner Erlenmaier, Gerlingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 850 days.

(21) Appl. No.: 11/341,861

(22) Filed: Jan. 26, 2006

(65) Prior Publication Data

US 2006/0144831 A1 Jul. 6, 2006

Related U.S. Application Data

(63) Continuation of application No. PCT/EP2004/006948, filed on Jun. 26, 2004.

(30) Foreign Application Priority Data

Jul. 26, 2003 (EP) ..... 03017009

(51) Int. Cl.
*B21D 5/08* (2006.01)
*B30B 1/18* (2006.01)

(52) U.S. Cl. ..... 83/623; 83/561; 83/684

(58) Field of Classification Search ..... 83/623, 83/561, 104, 667, 669, 523, 575–577, 681–691, 83/532; 72/430
See application file for complete search history.

(56) References Cited

U.S. PATENT DOCUMENTS

| | | | | |
|---|---|---|---|---|
| 5,136,521 | A | 8/1992 | Van Daalen et al. | |
| 5,259,642 | A | 11/1993 | Müller et al. | |
| 5,325,755 | A * | 7/1994 | Morita | 83/559 |
| 6,021,658 | A | 2/2000 | Liinamaa et al. | |
| 6,408,726 | B1 | 6/2002 | Taijonlahti et al. | |

FOREIGN PATENT DOCUMENTS

| | | |
|---|---|---|
| DE | 10133165 | 1/2003 |
| JP | 59157728 | 10/1984 |
| JP | 3186490 | 8/1991 |
| JP | 4258326 | 9/1992 |
| JP | 7088573 | 4/1995 |
| JP | 08-001399 | 1/1996 |
| JP | 9085355 | 3/1997 |
| JP | 2000317689 | 11/2000 |
| JP | 2002192385 | 7/2002 |

OTHER PUBLICATIONS

Office Action from corresponding Japanese Application No. 2006-521410, mailed Oct. 30, 2008, with English translation, 6 pages.

Office Action from corresponding Japanese Application No. 2006-521410, mailed Jan. 8, 2010, with English translation, 5 pages.

* cited by examiner

*Primary Examiner* — Stephen Choi
(74) *Attorney, Agent, or Firm* — Fish & Richardson P.C.

(57) ABSTRACT

Tool holding systems described herein include a tool holder configured to releasably retain a metal-processing tool and to define a tool holder passage extending along a stroke axis, an adjustment drive operable to rotate the tool holder about the stroke axis, and a stroke drive including a spindle operable independent of the adjustment drive to translate the tool holder along the stroke axis. The stroke drive defines a stroke drive passage cooperating with the tool holder passage to define a waste disposal passageway through the tool holding system.

17 Claims, 9 Drawing Sheets

TOOL HOLDING SYSTEM

CROSS REFERENCE TO RELATED APPLICATIONS

This application is a continuation of PCT application serial number PCT/EP2004/006948, filed Jun. 26, 2004, which claims priority to European Patent Application No. 03 017 009.6, filed Jul. 26, 2003.

TECHNICAL FIELD

This description relates to a tool holding system for metal-processing machines, such as punches and laser cutting machines and the like.

BACKGROUND

A machine tool including a punch machine with a die which can be raised and lowered is disclosed in EP 0 417 836 B1. The stroke movement of the die is generated by means of a tool stroke drive which in turn comprises a hydraulic piston-cylinder unit and a wedge gear. The piston-cylinder unit is arranged horizontally and moves a first gear wedge of the wedge gear in the horizontal direction. The first gear wedge has on its side facing upwards a wedge surface angled towards the horizontal. On this wedge surface of the first gear wedge rests a second gear wedge of the wedge gear with a corresponding wedge surface. The second gear wedge supports on its top a die holder and via this the die to be raised or lowered. By means of the wedge gear the horizontally oriented drive movement of the piston-cylinder unit is transformed into a vertical movement of the die. As well as the die, the die holder and the gear wedges of the wedge gear are fitted with orifices passable in the vertical direction, through which for example punching waste occurring at the machining point can leave the working area of the machine.

Because of the configuration described, the tool stroke drive of the previously known punch machine and hence the punch machine itself are relatively large.

SUMMARY

According to one aspect, a tool stroke drive includes a spindle gear, of which the at least one spindle runs in the stroke direction. In any case transverse to the stroke direction—and with a corresponding design also in the stroke direction—the tool stroke drive according to the invention is extremely compact. At the same time, a passage is left clear which continues into the orifice of the tool holder in the stroke direction. The accessibility of the working area of the machine tool or of the machining tool through the tool holder is consequently not hindered by the presence of the tool stroke drive. The passage can, for example with the die integrated into the tool holder, serve to discharge punching waste from the working area of the machine tool. If as an alternative to a punch tool a laser cutting head can be attached to the tool holder, the laser beam originating from the beam source can be directed to this through the passage left clear by the spindle gear and/or the rotary drive of the tool stroke drive. Various implementation provide a compact construction of the tool stroke drive and hence a compact construction of the entire machine.

In some embodiments, the passage continuing into the orifice of the tool holder in the stroke direction is formed by the inner recess of a hollow spindle of the spindle gear and provides a compact configuration. This embodiment is characterized by particular compactness.

In some embodiments, the spindle drive of machine tools according to the invention can include several spindle-spindle nut units which are arranged about the passage continuing into the orifice of the tool holder. Also in the context of the invention it is conceivable to provide a spindle-spindle nut unit with a hollow spindle forming said passage and in addition arrange at least one further spindle-spindle nut unit at a distance from the passage.

In some embodiments, multi-spindle solutions are characterized generally by high dynamics. This allows the performance of fast short strokes of the tool holder with high acceleration. In addition, the use of multiple spindle-spindle nut units allows the transmission of particularly large forces. Finally, when several spindle-spindle nut units are used, these can be used as a twist lock for the tool holder or a housing fitted with the tool holder during performance of the strokes. Expensive measures for twist prevention are consequently not required. This circumstance in turn contributes to a compact construction of the entire arrangement.

Drive ring gears with inner recess are provided in the interests of a compact construction of the rotary drive and hence the entire tool stroke drive. A particularly compact arrangement arises if a drive ring gear drives one or more spindle-spindle nut units without an intermediate gear. In this case only a coupling is required between the drive ring gear and the spindle-spindle nut unit or units concerned. Elastic couplings or rigid ones, switchable or non-switchable couplings are conceivable.

The tool stroke drive becomes particularly compact if the drive ring gear is formed by the rotor of an electric motor serving as a drive motor for the tool stroke drive. In particular if a torque motor is used as an electric motor, high torques can be transmitted to the spindle gear or gears without an intermediate gear. In some embodiments, the drive ring gear surrounds the at least one spindle-spindle nut unit to be driven. In some embodiments, the same drive ring gear can be used for common drive of a multiplicity of spindle-spindle nut units.

The compact tool stroke drive of machine tools according to the invention can be used in particular to drive punches and/or dies. Both working strokes for punch workpiece machining and adjustment strokes for positioning the punching tool concerned can be performed as strokes.

According to another aspect, a tool holding system includes a tool holder configured to releasably retain a metal-processing tool and define a tool holder passage extending along a stroke axis, an adjustment drive operable to rotate the tool holder about the stroke axis, and a stroke drive including a spindle operable independent of the adjustment drive to translate the tool holder along the stroke axis. The stroke drive defines a stroke drive passage cooperating with the tool holder passage to define a waste disposal passageway through the tool holding system.

In various embodiments, the adjustment drive includes a stator and rotor which are concentric with the tool holder passage. The spindle is coupled to the rotor and defines an inner recess cooperating with the stroke drive passage. The stroke drive can also includes a plurality of spindle-spindle nut units mounted for rotation and positioned to commonly engage an inner surface of the spindle. The stroke drive can further include a number of spindle-spindle nut units mounted for rotation and positioned to commonly engage an outer surface of the spindle. The metal-processing tool can include a punch, die or a laser cutting head.

According to another aspect, a machine for processing a workpiece includes a machine frame including an upper frame leg and a lower frame leg, a workpiece table configured to support a workpiece disposed generally between the upper and lower frame legs, and a tool holding system as described herein affixed to the free end of at least one of the upper frame leg and the lower frame leg.

In some embodiments of the foregoing aspect, a first tool handling system is affixed to the free end of the upper frame leg and a second tool handling system is affixed to free end of the lower frame leg.

In some embodiments, the metal-processing tool of the first tool handling system includes a punch and the metal-processing tool of the second tool handling system includes a die. In some embodiments, the metal-processing device includes a laser cutting head and the machine for processing a workpiece includes a laser operable to direct a laser beam through the cutting head and the waste disposal passage to the workpiece.

In some embodiments the adjustment drive includes a stator and rotor which are concentric with the tool holder passage. In some embodiments, the spindle is coupled to the rotor and defines an inner recess cooperating with the stroke drive passage. In still other embodiments, the stroke drive further includes multiple spindle-spindle nut units mounted for rotation and positioned to commonly engage an inner surface of the spindle.

In some embodiments the stroke drive further includes a plurality of spindle-spindle nut units mounted for rotation and positioned to commonly engage an outer surface of the spindle. In some embodiments, the machine for processing a workpiece includes a workpiece table for supporting a workpiece which includes a controllable flap proximate the metal-processing tool, the flap being moveable to reveal a chute for delivery of workpiece waste to a collection container disposed below the table.

According to still another aspect, a method of machining a workpiece includes retaining a metal-processing tool on a tool holder, rotating the position of the tool holder about a stroke axis with an adjustment drive, translating the position of the tool holder along the stroke axis with a stroke drive having a spindle operable independent of the adjustment drive, maintaining an access passage through the tool holder and the stroke drive while adjusting the position of the tool holder and processing the workpiece with the metal-processing tool.

In some embodiments, the metal-processing tool includes a laser cutting head and the method also includes illuminating a laser through the laser cutting head and the access passage. In some embodiments, the method also includes delivering workpiece waste through the access passage during processing the workpiece.

According to another aspect, a method of machining a workpiece includes retaining a first metal-processing tool on a first tool holder, rotating the position of the first tool holder about a stroke axis with a first adjustment drive, translating the position of the first tool holder along the stroke axis with a first stroke drive including a first spindle operable independent of the first adjustment drive, retaining a second metal-processing tool on a second tool holder, rotating the position of the second tool holder about a stroke axis with a second adjustment drive, translating the position of the second tool holder along the stroke axis with a second stroke drive including a second spindle operable independent of the second adjustment drive, and maintaining a first passage through the first tool holder and the first stroke drive while adjusting the position of the first tool holder.

According to still another aspect, a machine tool for processing a workpiece positioned in a working area includes a tool holder to support a punch tool and defining an opening proximate the working area of the machine tool, the tool holder configured to rotate about a stroke axis and a tool stroke drive attached to the tool holder at a first end and including a spindle gear mounted for rotation about the stroke axis, a rotary drive coupled to the spindle gear, and at least one spindle-spindle nut unit operably connected with the spindle gear with a spindle, the rotary drive configured to move the tool stroke drive along the stroke axis. The tool holder and stroke drive holder define a continuous central bore.

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 1:
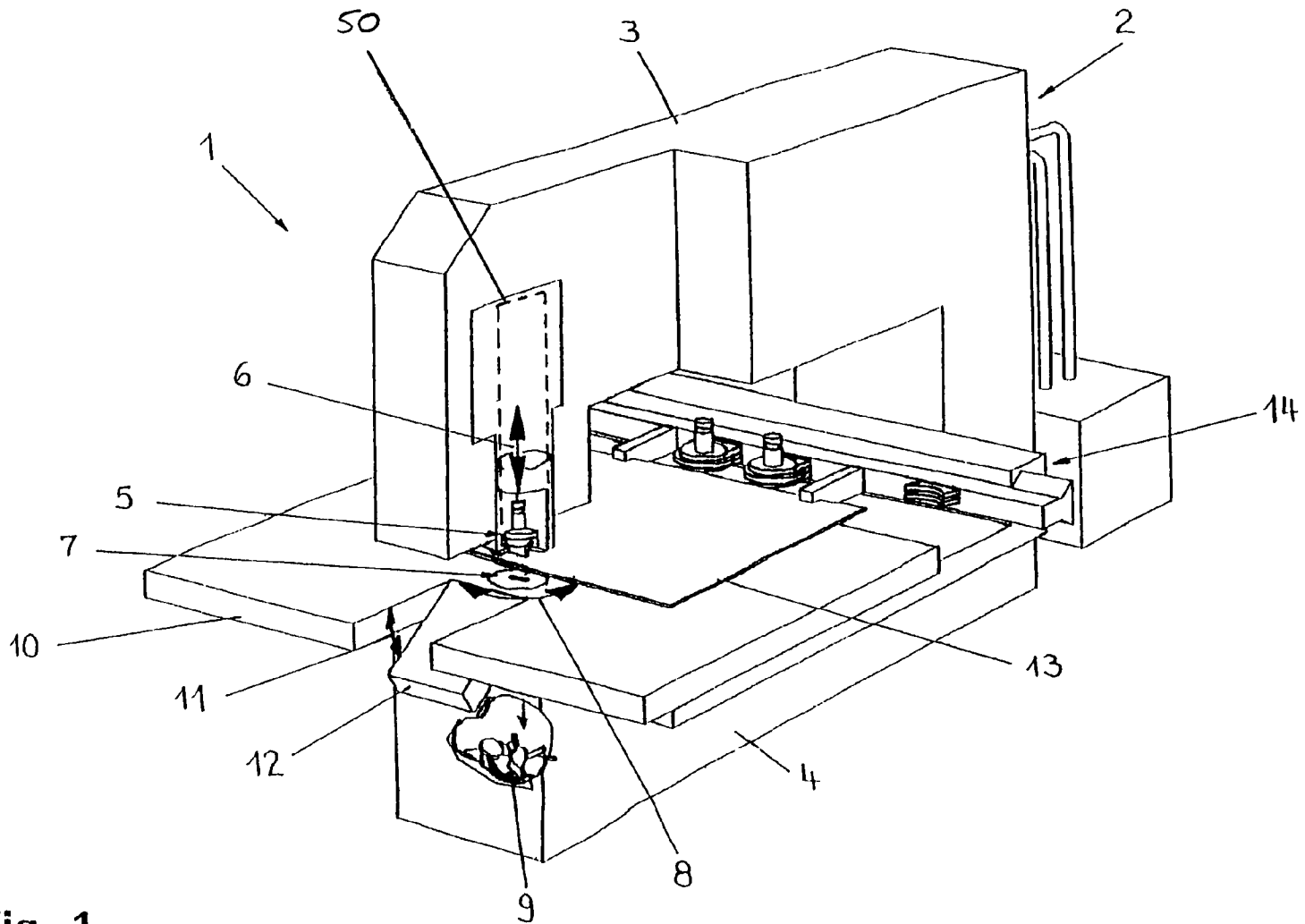
FIG. 1 shows a punch machine with die and punch in highly schematic, partly cut-away overall view.

According to FIG. 1, a punch machine 1 has a C-shaped machine frame 2 with an upper frame leg 3 and a lower frame leg 4. At the free end of the upper frame leg 3, a punch 5 can be raised and lowered in a stroke direction 6 indicated by a double arrow. The machine 1 can also include a laser 50 (shown in phantom) in place of or in conjunction with the punch 5. The stroke movement of the punch 5 is achieved by means of a tool stroke drive described in detail below.

Opposite the punch 5 at the free end of the lower frame leg 4 is arranged a die 7. This too can be moved in the stroke direction 6 by means of the tool stroke drive explained in more detail below. Both the punch 5 and the die 7 are rotationally adjustable in the direction of a double arrow 8 about a rotary axis running in the stroke direction 6. Both the rotational adjustment and the stroke movement of the punch 5 and the die 7 are numerically controlled.

Below the die 7 in the inside of the lower frame leg 4 is provided a collection container 9 for punching waste. Finished parts produced by means of the punch 5 and die 7 are discharged out of the working area of the punch machine 1 via a flap 12 integrated into a workpiece table 10 and swivellable to and from in the direction of a double arrow 11.

In the example shown, a plate 13 is to be processed with the punch machine 1, and is positioned in the known manner in relation to the punch 5 and the die 7 by means of a coordinate guide 14 accommodated in the gap between the upper frame leg 3 and the lower frame leg 4.

Figure 2:
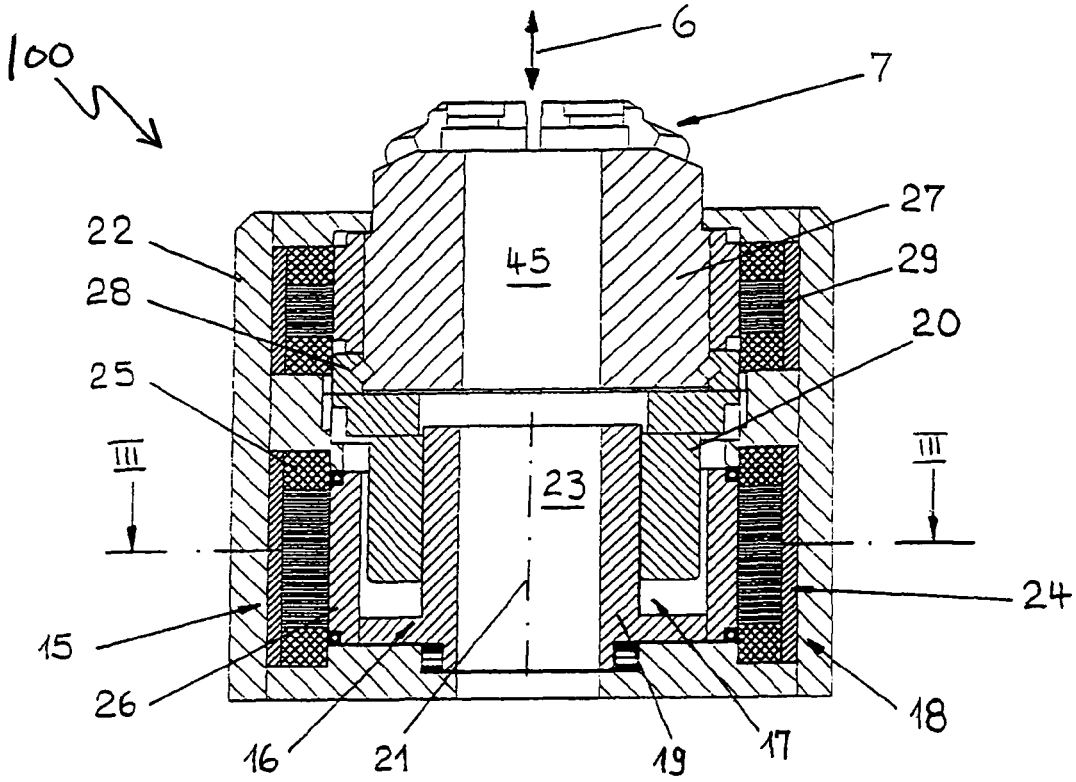
FIG. 2 shows a longitudinal section of a stroke drive of a first design for the die in FIG. 1.
Figure 3:
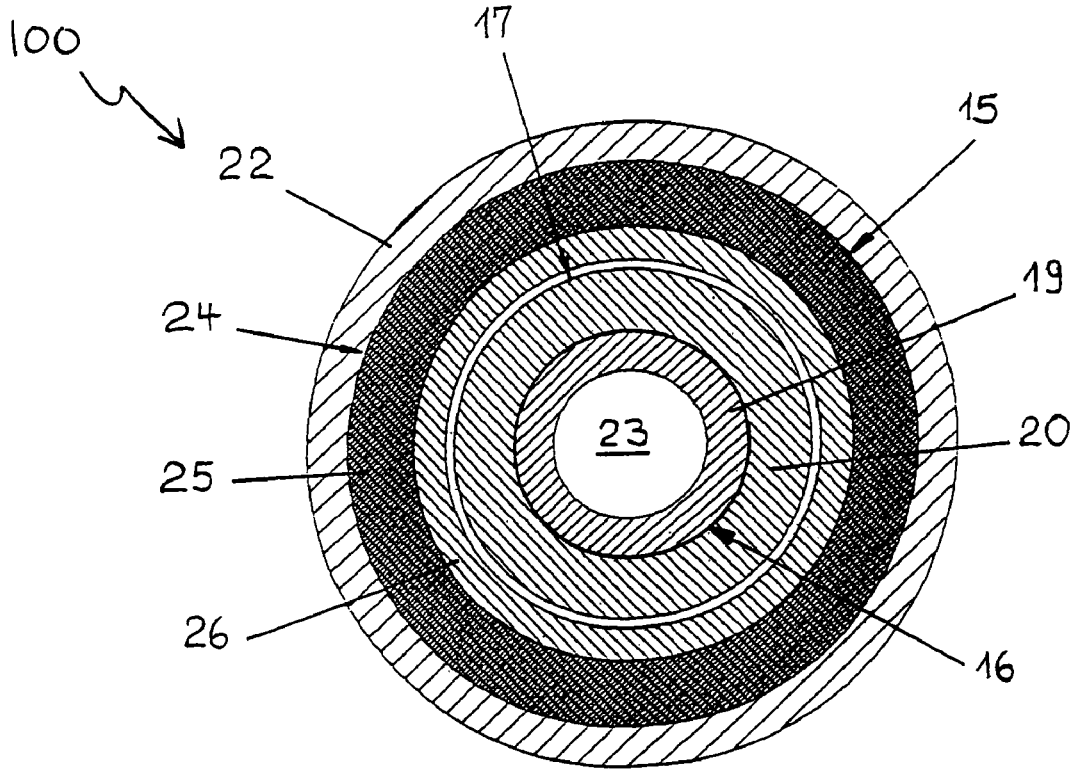
FIG. 3 shows a cross-section of the stroke drive according to FIG. 2 with a cut plane running perpendicular to the drawing plane in FIG. 2 and in the direction of line III-III.

A tool holding system 100 is shown in detail in FIGS. 2 and 3 as tool stroke drive 15 and includes a spindle gear 16 with a spindle-spindle nut unit 17 and a rotary drive 18 provided for this. Parts of the spindle-spindle nut unit 17 are a spindle 19 formed as a hollow spindle and a spindle nut 20. The spindle 19 runs with an axis 21 in the stroke direction 6. It is mounted rotatable about the axis 21 on a housing 22 of the tool stroke drive 15 and fixed in the direction of axis 21. In its inside, it has an inner recess 23 open at both axial ends.

The rotary drive 18 for the spindle-spindle nut unit 17 is an electric motor. A torque motor 24 serves as a drive motor and is mounted with a stator 25 on the housing 22 of the tool stroke drive 15. A rotor 26 of the torque motor 24 revolves about the axis 21 of the spindle 19 and is rigidly coupled to this at an outer flange of the spindle 19. A housing of the torque motor 24, evident in FIG. 2, is not shown in FIG. 3 for the sake of clarity.

The spindle nut 20 of the spindle-spindle nut unit 17 is drive-connected with a tool holder 27 for the die 7. A corresponding form-fit connection 28 between the spindle nut 20 and the tool holder 27 acts in the direction of the axis 21 of the spindle 19 and hence in the stroke direction 6. The spindle 19 revolving about axis 21 is prevented from carrying with it the tool holder 27 and spindle nut 20 by a twist lock of the tool holder 27 not shown in detail. A rotary adjustment movement of the tool holder 27 about the axis 21 of the spindle 19 can however be executed by means of an adjustment motor 29. The adjustment motor 29 serves to adjust the die 7 in the direction of the double arrow 8 in FIG. 1. On rotary adjustment of the tool holder 27 or the die 7, the twist lock of the tool holder 27 is disabled.

By means of the tool stroke drive 15, the die 7 can be raised and lowered in the stroke direction 6. FIG. 2 shows the die 7 in its upper end position. The die 7 assumes this position during punching of the plate 13. If after punching, the plate 13 is to be moved by means of the coordinate guide 14 in relation to the punch 5 and die 7, the die 7 is lowered by means of the tool stroke drive 15. This prevents the plate 13, during its subsequent movement by means of the coordinate guide 14, on its underside coming into contact with the die 7 and consequently scratches being formed on the underside of the plate 13. In addition it is conceivable to use the tool stroke drive 15 to perform the working strokes necessary for the punch machining of the plate 13. In this case the relative movement between the punch 5 and the die 7 is generated by stroke movement of the die 7 when the punch 5 is stationary in the stroke direction 6.

Figure 4:
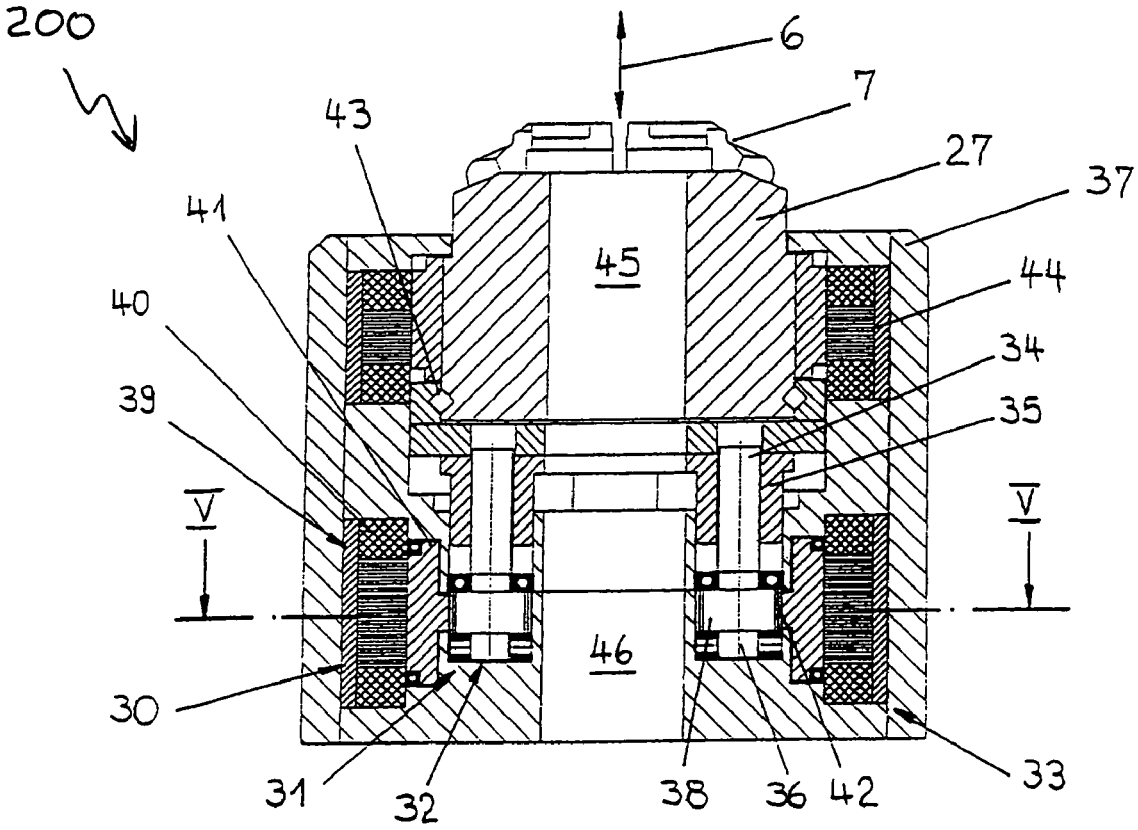
FIG. 4 shows a longitudinal section of a stroke drive of a second design for the die in FIG. 1.
Figure 5:
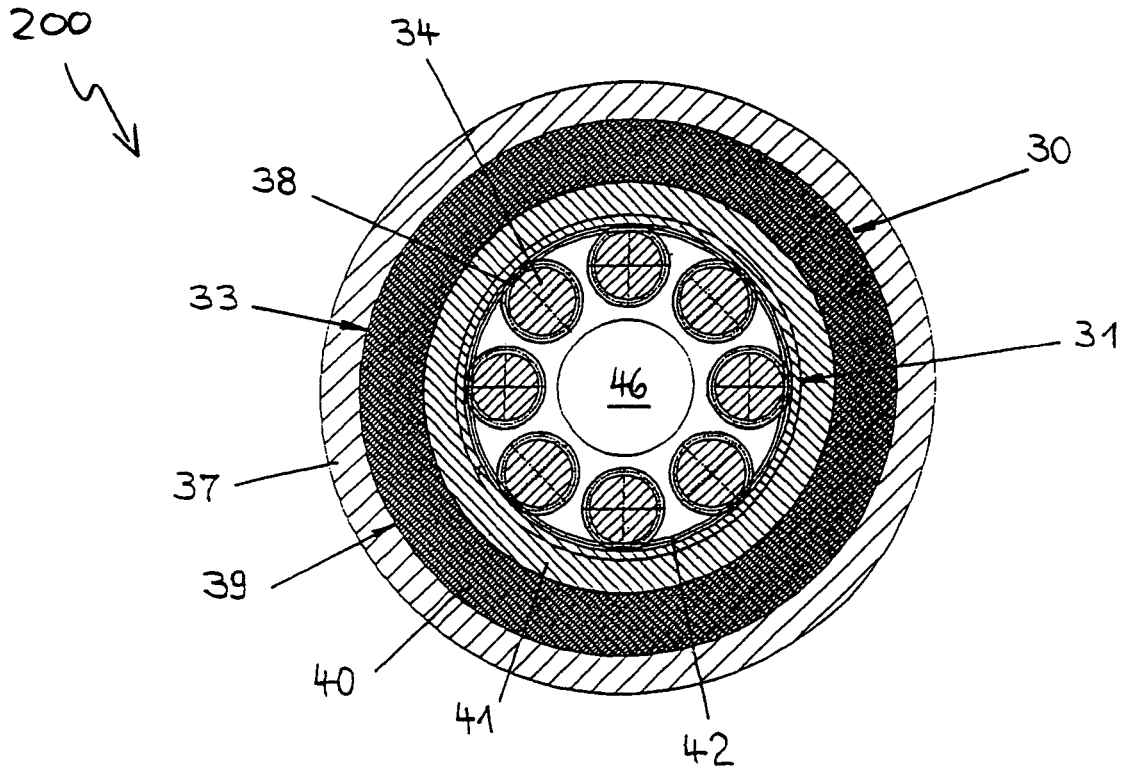
FIG. 5 shows a cross-section of the stroke drive according to FIG. 4 with a cut plane running perpendicular to the drawing plane in FIG. 4 and in the direction of line V-V.

A tool holding system 200 is shown in FIGS. 4 and 5 for lifting and lowering the die 7 in the form of a tool stroke drive 30 includes a spindle gear 31 with a total of eight spindle-spindle nut units 32 and a rotary drive 33.

Each of the spindle-spindle nut units 32 has a spindle 34 and a spindle nut 35 sitting thereon. Axes 36 of the spindles 34 run in the stroke direction 6. On a housing 37 of the tool stroke drive 30, the spindles 34 are mounted rotatable about their axes 36 and fixed in the axial direction. Each spindle 34 has an outer collar 38 with outer toothing.

A torque motor 39 with a stator 40 and a rotor 41 serves for common rotation of the spindles 34. The rotor 41 revolves about an axis extending in the stroke direction 6 and engages with an inner toothing 42 on the outer toothings of the outer collars 38 on the spindles 34. Like the rotor 26 of the torque motor 24 in FIGS. 2 and 3, the rotor 41 of the torque motor 39 forms a drive ring gear with inner recess.

Via a form-fit connection 43, the spindle nuts 35 of the spindle-spindle nut units 32 are actively connected in the stroke direction 6 with the tool holder 27 for the die 7. An adjustment motor 44 ensures the rotary adjustment in the direction of the double arrow 8 in FIG. 1 of the tool holder 27 which can be raised and lowered by means of the tool stroke drive 30.

An orifice 45 in the inside of the tool holder 27 aligns according to FIGS. 2 and 3 with the passage-forming inner recess 23 in the spindle 19 provided there, in the situation in FIGS. 4 and 5 it aligns with a passage in the form of a clear space 46 about which are arranged the spindle-spindle nut units 32 and which is surrounded by the torque motor 39. Punching waste generated on machining the plate 13 can leave the working area of the punch machine 1 under the effect of gravity through the orifice 45 of the tool holder 27 and the inner recess 23 of the spindle 19 or the clear space 46 between the spindle-spindle nut units 32.

Like the tool stroke drive 15 in FIGS. 2 and 3, the tool stroke drive 30 in FIGS. 4 and 5 can perform both an adjustment movement and a working stroke of the die 7.

Figure 6:
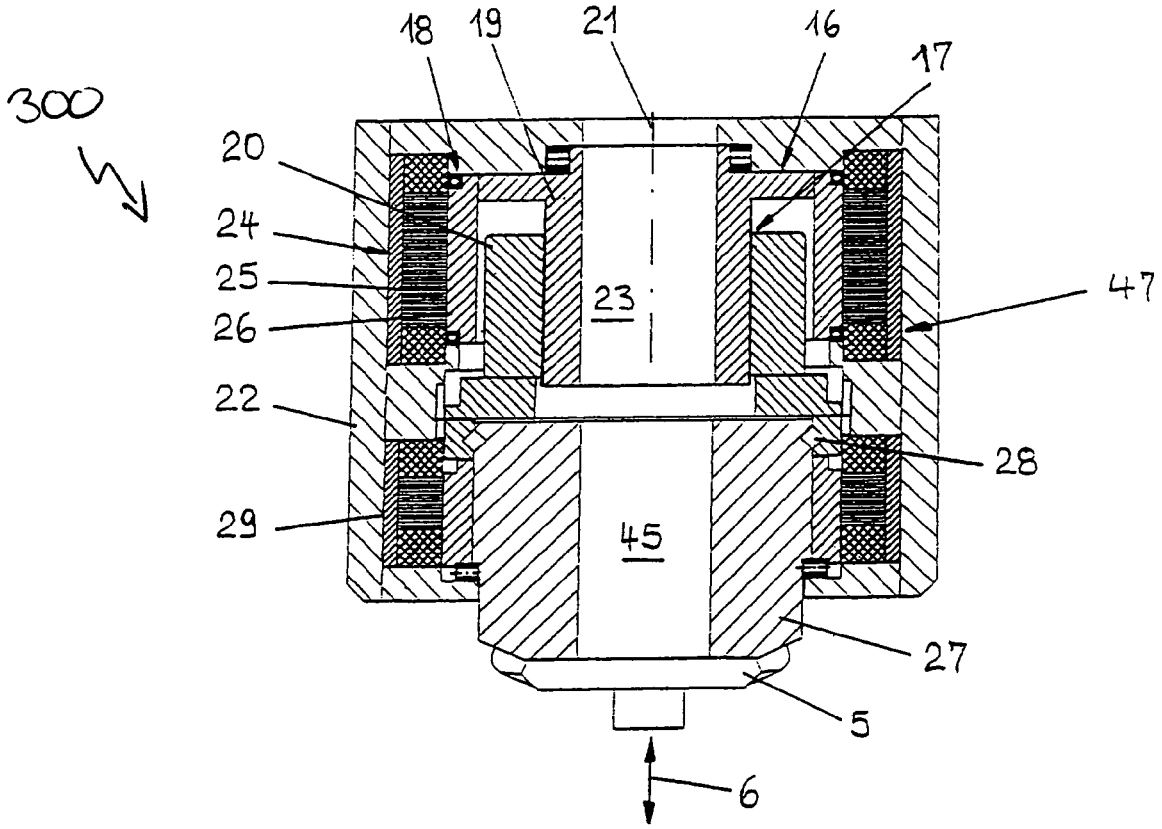
FIG. 6 shows a longitudinal section of a stroke drive of a first design for the punch in FIG. 1.
Figure 7:
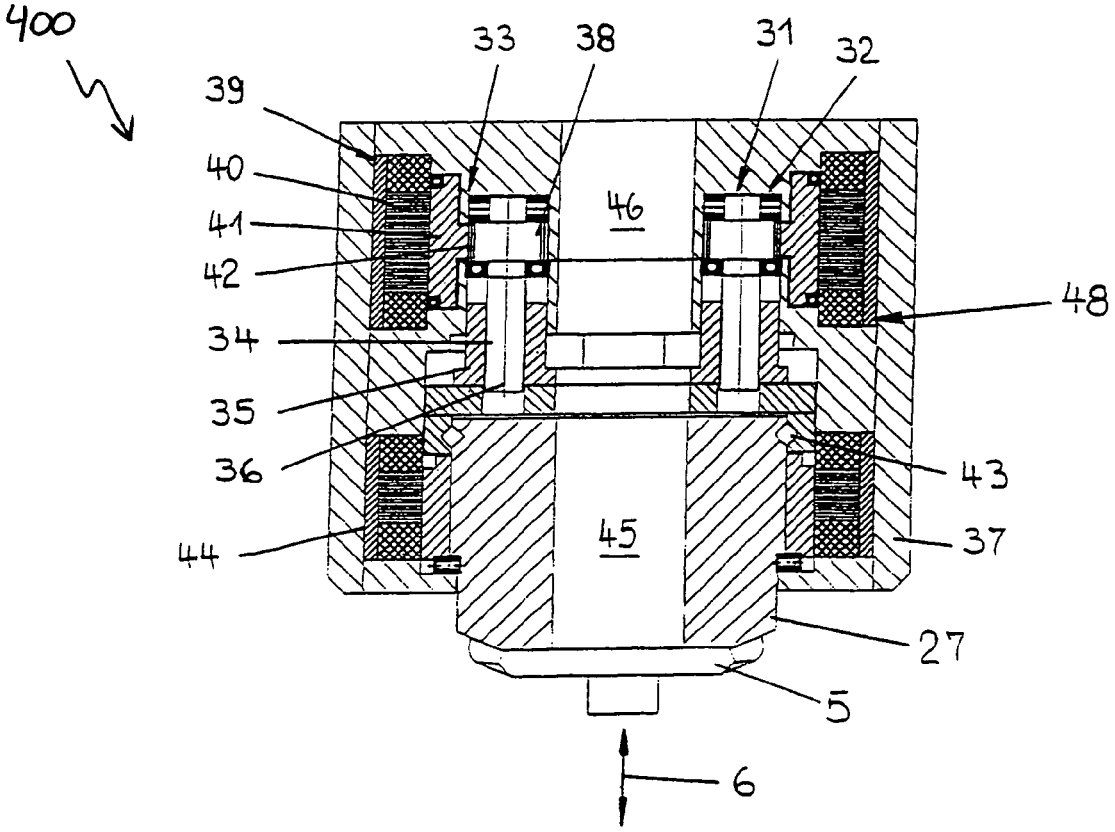
FIG. 7 shows a longitudinal section of a stroke drive of a second design for the punch in FIG. 1.

A tool holding system 300 including a tool stroke drive 47 is shown in FIG. 6 and a tool holding system 400 including a tool stroke drive 48 is shown in FIG. 7 serve to move the punch 5 in the stroke direction 6. In its construction, the tool stroke drive 47 for the punch 5 corresponds to the tool stroke drive 15 for the die 7. The tool stroke drive 48 for the punch 5 is structured substantially the same as the tool stroke drive 30 for the die 7. The same reference numerals are used for the components of the tool stroke drives 47, 48 as for the corresponding components of the tool stroke drives 15, 30.

Figure 8:
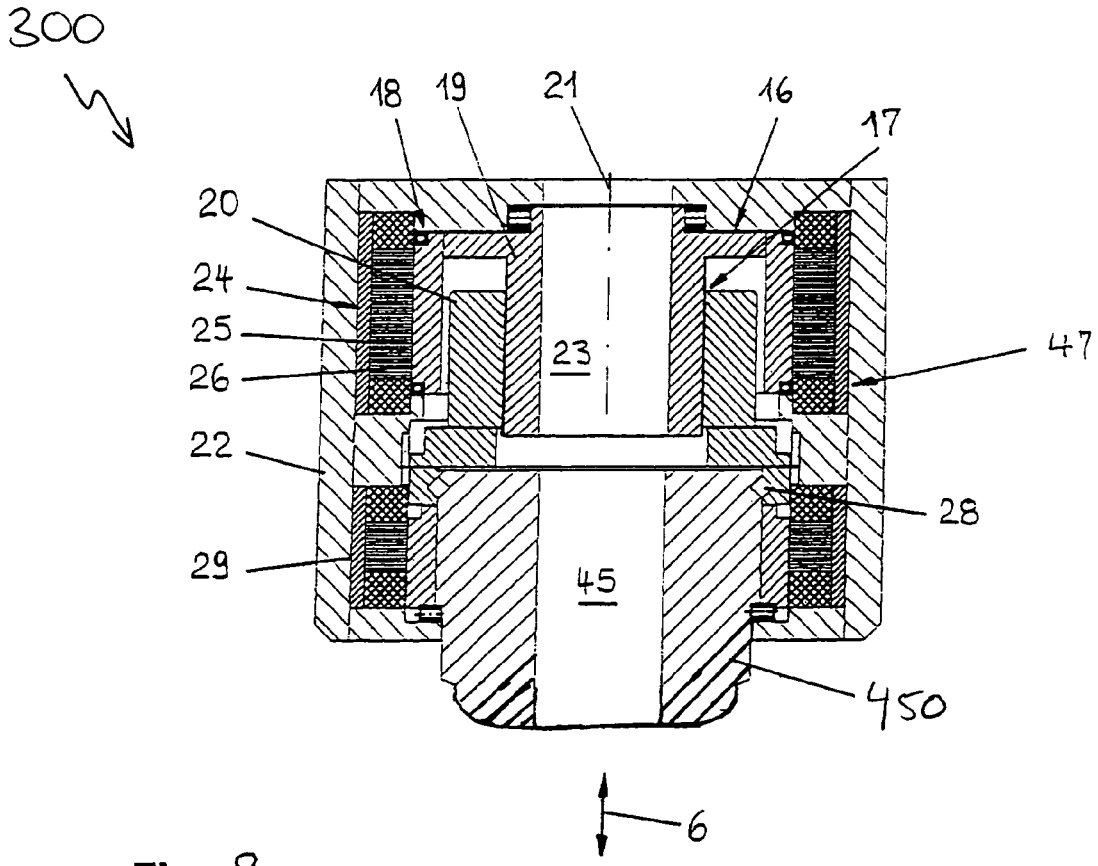
FIG. 8 shows a longitudinal section of the stroke drive of FIG. 6 including a laser cutting head.
Figure 9:
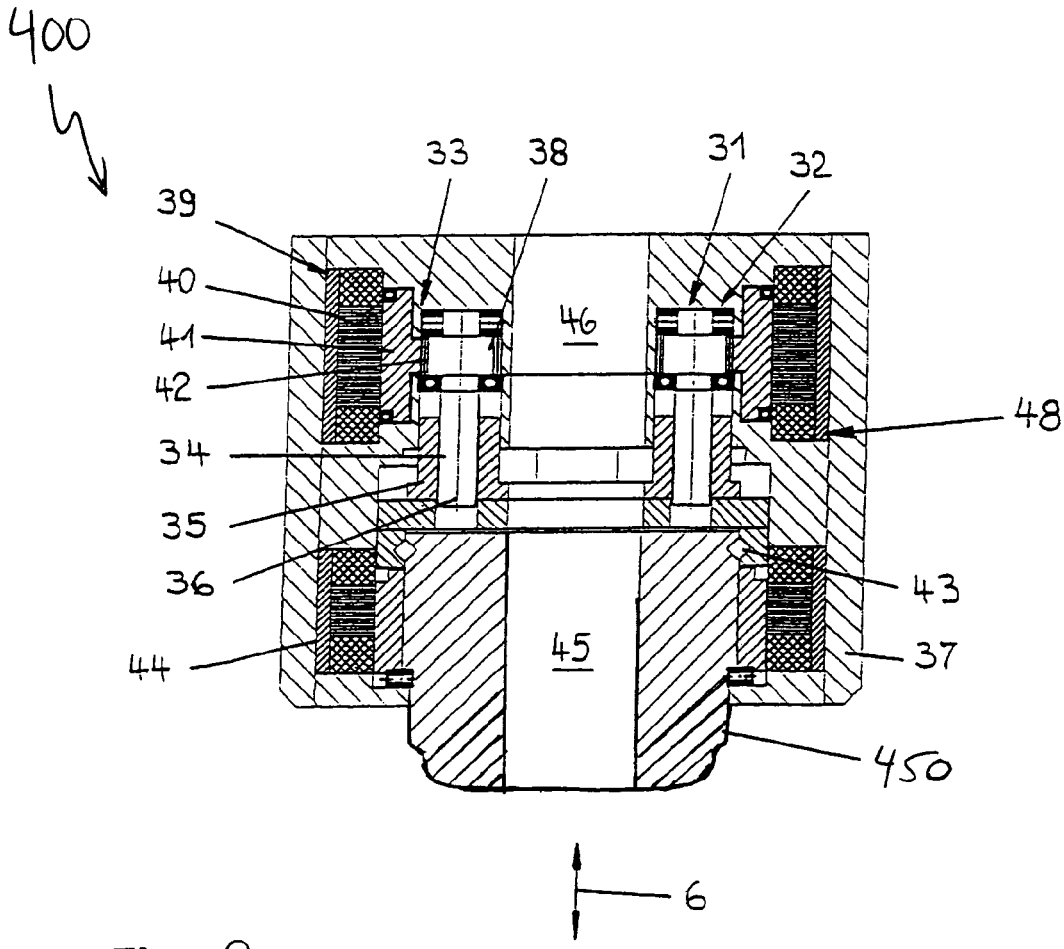
FIG. 9 shows a longitudinal section of the stroke drive of FIG. 7 including a laser cutting head.

FIG. 8 show a laser cutter head 450 fitted to the tool holding system 300 of FIG. 6 instead of the punch 5 and FIG. 9 shows the laser cutter head 450 fitted to the tool holding system 400 of FIG. 7 instead of the punch 5. In these implementations, the laser beam from laser 50 (FIG. 1) is directed through the inner recess 23 (FIG. 8) or the space 46 (FIG. 9) and the opening 45 in the laser cutting head 450.

A number of embodiments of the invention have been described. Nevertheless, it will be understood that various modifications may be made without departing from the spirit and scope of the invention. Accordingly, other embodiments are within the scope of the following claims.

What is claimed is:

1. A tool holding system comprising:

a tool holder configured to releasably retain a metal-processing tool and defining a tool holder passage extending along a stroke axis;

an adjustment drive operable to rotate the tool holder about the stroke axis; and a stroke drive comprising a spindle operable independent of the adjustment drive to translate the tool holder along the stroke axis, wherein the stroke drive defines a stroke drive passage cooperating with the tool holder passage to define a waste disposal passageway through the tool holding system.

2. The system according to claim 1, wherein the adjustment drive comprises a stator and rotor which are concentric with the tool holder passage.

3. The system according to claim 2, wherein the spindle is coupled to the rotor and defines an inner recess cooperating with the stroke drive passage.

4. The system according to claim 3, wherein the stroke drive further comprises a plurality of spindle-spindle nut units mounted for rotation and positioned to commonly engage an inner surface of the spindle.

5. The system according to claim 3, wherein the stroke drive further comprises a plurality of spindle-spindle nut units mounted for rotation and positioned to commonly engage an outer surface of the spindle.

6. The system according to claim 1, wherein the metal-processing tool comprises a punch, die or a laser cutting head.

7. The machine according to claim 6, wherein the stroke drive further comprises a plurality of spindle-spindle nut units mounted for rotation and positioned to commonly engage an outer surface of the spindle.

8. The machine according to claim 6, further comprising a workpiece table for supporting a workpiece, the table comprising a controllable flap proximate the metal-processing tool, the flap being moveable to reveal a chute for delivery of workpiece waste to a collection container disposed below the table.

9. A machine for processing a workpiece, the machine comprising:

a C-shaped machine frame comprising an upper frame leg and a lower frame leg, each leg having a free end;

a workpiece table configured to support a workpiece disposed generally between the upper and lower frame leg; and the tool holding system of claim 1 affixed to the free end of at least one of the upper frame leg and the lower frame leg.

10. The machine according to claim 9, wherein the tool handling system is affixed to the free end of the upper frame leg and a second tool handling system is affixed to the free end of the lower frame leg.

11. The machine according to claim 9, wherein the metal-processing tool of the first tool handling system comprises a punch and the metal-processing tool of the second tool handling system comprises a die.

12. The machine according to claim 9, wherein the metal-processing device comprises a laser cutting head.

13. The machine according to claim 12, further comprising a laser operable to direct a laser beam through the cutting head and the waste disposal passage to the workpiece.

14. The machine according to claim 9, wherein the adjustment drive comprises a stator and rotor which are concentric with the tool holder passage.

15. The machine according to claim 9, wherein the spindle is coupled to the rotor and defines an inner recess cooperating with the stroke drive passage.

16. The machine according to claim 9, wherein the stroke drive further comprises a plurality of spindle-spindle nut units mounted for rotation and positioned to commonly engage an inner surface of the spindle.

17. A machine tool for processing a workpiece positioned in a working area, the machine tool comprising:

a tool holder to support a punch tool and defining an opening proximate the working area of the machine tool, the tool holder configured to rotate about a stroke axis; and a tool stroke drive comprising a spindle gear that comprises a spindle-spindle nut unit;

wherein the spindle-spindle nut unit comprises a spindle and a spindle nut operably connected with each other and the spindle nut is attached to the tool holder, wherein the tool stroke drive is configured to move the spindle nut and the tool holder along the stroke axis, and;

wherein the tool holder and the tool stroke drive holder define a continuous central bore.

* * * * *